United States Patent [19]

Murari et al.

[11] Patent Number: 4,801,860

[45] Date of Patent: Jan. 31, 1989

[54] VOLTAGE STABILIZER WITH A MINIMAL VOLTAGE DROP DESIGNED TO WITHSTAND HIGH VOLTAGE TRANSIENTS

[75] Inventors: Bruno Murari, Monza; Marco Morelli, Livorno, both of Italy

[73] Assignee: SGS-Thomson Microelectronics S.p.A., Agrate Brianza, Italy

[21] Appl. No.: 159,290

[22] Filed: Feb. 23, 1988

[30] Foreign Application Priority Data

Feb. 23, 1987 [IT] Italy ..... 19450 A/87

[51] Int. Cl.[4] ..... G05F 1/56

[52] U.S. Cl. ..... 323/274; 323/275

[58] Field of Search ..... 323/273, 274, 275, 303

[56] References Cited

U.S. PATENT DOCUMENTS 4,327,319 4/1982 Swisher et al. ..... 323/275

4,543,522 9/1985 Moreau ..... 323/274

4,560,918 12/1985 Callen ..... 323/273

*Primary Examiner*—William H. Beha, Jr.

*Assistant Examiner*—Jeffrey Sterrett

*Attorney, Agent, or Firm*—Wenderoth, Lind & Ponack

[57] ABSTRACT

A voltage stabilizer with a minimal voltage drop designed to withstand high voltage transients includes a "series" type voltage regulator circuit with an NPN power transistor. The collector terminal of this transistor is connected to ground via a capacitor and to the cathode of a diode whose anode forms an input terminal of the stabilizer. The base terminal of the power transistor is connected to the collector terminals of first and second PNP transistors which have their emitter terminals respectively connected to the cathode and anode of the diode and their base terminals connected to a circuit biasing circuit.

16 Claims, 2 Drawing Sheets

VOLTAGE STABILIZER WITH A MINIMAL VOLTAGE DROP DESIGNED TO WITHSTAND HIGH VOLTAGE TRANSIENTS

BACKGROUND OF THE INVENTION

The present invention relates to voltage stabilizer devices and in particular to voltage stabilizers comprising monolithically integrated regulator circuits for use in motor vehicle applications.

Voltage stabilizers receive a voltage whose value is not defined and supply a voltage with a well defined and constant value or values.

Voltage stabilizers may be advantageously used as supply devices for other devices: i.e.—as a function of the load connected thereto, they in fact supply the current needed to keep the voltage supplied to this load constant.

At present, for reasons of compactness, ease of use and economic viability, integrated circuit electronic voltage stabilizers are tending to be constructed for all types of applications.

In general, the electrical magnitudes of voltage and current at the output terminals of these electronic voltage stabilizers are determined by an internal regulation circuit which is monolithically integrated and comprises a circuit feedback means which is connected to the output terminals and which is sensitive to the instantaneous values of these electrical magnitudes.

The lower limit of the correct operating range of an electronic voltage stabilizer is pinpointed by a parameter known in general in the technical literature by the term "drop-out", i.e. the difference between the minimum value of the input voltage required for the correct operation of the stabilizer and the value of the constant voltage which the stabilizer has to supply as output, which thus shows the voltage drop of the device.

Voltage stabilizers used in motor vehicle applications must satisfy particularly strict requirements as a result of operating conditions which entail major variations in temperature and humidity as well as considerable, and in some cases abrupt, variations in the supply voltage generated by the battery of the vehicle.

These stabilizers must therefore be extremely reliable, accurate and stable, while still being economically viable, and must in particular have a low drop-out since the supply voltage supplied by the battery of a vehicle may normally drop, during cold starting, from a typical 14.4 V at charge to approximately 6 V. Account must also be taken of the positive and negative voltage peaks with a maximum amplitude of up to 150 V which may be present on the supply line of a vehicle as a result of the switching transients of inductive loads (starter coils, relays, etc.) or of disconnections or breakages of electrical connection cables.

The monolithically integrated voltage regulator circuits most commonly used in voltage stabilizers for motor vehicle applications are those with a "series" type regulation, in which the output voltage is regulated to a constant value by a bipolar power transistor connected in series with an output terminal, the base of the transistor being appropriately controlled to cause it to conduct as a function of the load.

A suitably dimensioned power transistor can also withstand, without drawbacks, positive voltage peaks having a high amplitude and may thus continue to ensure the regulation of the output voltage.

Negative peaks in the input voltage could, however, cause the transistor to be cut off, with interruptions, albeit brief, in the supply to the user circuits connected to the voltage stabilizer, with serious drawbacks when these comprise memories and integrated logic circuits which require a constant supply.

For this reason voltage stabilizers comprising "series" type regulation circuits also comprise a capacitor and an input diode, which are not integrated, in order to maintain, during very short negative transients in the input voltage, an adequate supply to the power transistor.

FIGS. 1 and 2 of the drawings respectively show diagrams of a known voltage stabilizer with "series" type regulation by means of a PNP transistor and a known voltage stabilizer with "series" type regulation by means of an NPN power transistor.

The circuit diagram of FIG. 1 comprises a bipolar PNP transistor T having its emitter terminal connected to the cathode of a diode D whose anode forms an input terminal IN and to a first terminal of a capacitor C whose second terminal is connected to ground.

The collector terminal of the transistor T forms an output terminal OUT.

The base terminal of the transistor T is connected to the output terminal of a differential amplifier A whose non-inverting input is connected via a first resistor $R_1$ to the terminal OUT and, via a second resistor $R_2$, to ground.

The inverting input of the amplifier is connected to a voltage reference $V_R$.

The part of the diagram of FIG. 1 which shows the voltage regulator circuit which can be monolithically integrated has been enclosed in a rectangular block shown by dashed lines.

In the circuit diagram of FIG. 2 the PNP transistor T is replaced by a bipolar NPN transistor $T_1$. The output terminal of the differential amplifier A is not in this case connected directly to the base terminal of the transistor $T_1$ but to the base terminal of a bipolar PNP transistor $T_2$.

The emitter and collector terminals of the transistor $T_2$ are respectively connected to the collector terminal and to the base terminal of the transistor $T_1$.

All the other components of the diagram are identical to those of FIG. 1.

In both cases the capacitor C is charged via the diode D to the typical values of the battery voltage less the voltage drop at the diode, during normal charging conditions of the battery.

During the negative voltage transients, however, the diode D prevents the discharge of the capacitor C via the input terminal with the result that this capacitor can be discharged only via the transistor of the regulation circuit, enabling its conduction during the transient.

The two types of voltage stabilizer will now be compared, calculating their drop-out.

In the case of the stabilizer of FIG. 1 comprising a PNP power transistor, the drop-out is:

$$V_{DROP}=V_D+V_{CEsat}$$

in which $V_D$ is the voltage drop across the diode D when it is conducting and $V_{CEsat}$ is the collector-emitter voltage of the transistor T when it is saturated.

In the case, however, of the stabilizer of FIG. 2 comprising an NPN power transistor, it is:

$$V_{DROP}=V_D+V_{CEsat}+V_{BE}$$

in which $V_D$ is again the voltage drop at the input diode, $V_{CEsat}$ is the collector-emitter voltage of the transistor $T_2$ when it is saturated and $V_{BE}$ is the base-emitter voltage of the transistor $T_1$ when it is conducting.

It is thus possible to construct a voltage stabilizer with minimal drop-out using, as shown in FIG. 1, a regulation circuit comprising a PNP power transistor.

A voltage stabilizer of the type shown in FIG. 2 is, however, economically advantageous, since by using an NPN power transistor it is possible to achieve an overall occupation of integration area of the regulation circuit which is lower than that which can be achieved with a PNP power transistor.

It should be noted that the with the voltage stabilizers examined above, with equal current supplied to the load, it is generally necessary to insert an external capacitor between the output terminal OUT and ground in order to stabilize the regulation loop during operation.

If use is made of an NPN power transistor, this provides a regulation loop with a gain which is lower than that which can be achieved with a PNP power transistor so that it is possible to use an output capacitor having a lower capacitance which is thus less costly.

Since the production level of devices for use with motor vehicles is very high, these economic advantages are fairly substantial.

SUMMARY OF THE INVENTION

The object of the present invention is to provide a voltage stabilizer device with minimal drop-out designed to withstand high voltage transients, which is economically advantageous with respect to similar known voltage stabilizers.

The object may be achieved by providing a voltage regulator circuit comprising:

a first bipolar transistor of a first type of conductivity having a collector terminal and an emitter terminal and a base terminal;

second and third bipolar transistors of a second type of conductivity which is opposite to said first type of conductivity, each of said transistors having a collector terminal and an emitter terminal and a base terminal;

a differential amplifier having first and second input terminals and an output terminal;

said voltage regulator circuit having first and second input terminals and an output terminal and a common terminal;

a circuit biasing means connected between said first and second input terminals and said common terminal and having outputs connected to said base terminals of said second and third transistors;

a voltage divider means connected between said output terminal and said common terminal and having an output connected to said first input terminal of said differential amplifier;

wherein a reference voltage is connected to said second input terminal of said differential amplifier;

and wherein said collector terminal and emitter terminal of said first transistor are respectively connected to said first input terminal and output terminal and said base terminal of said first transistor is connected to said output of said differential amplifier and said collector terminal and emitter terminal of said second transistor are respectively connected to said output of said differential amplifier and said first input terminal;

and wherein said collector terminal and said emitter terminal of said third transistor are respectively connected to said output of said differential amplifier and said second input terminal.

BRIEF DESCRIPTION OF THE DRAWINGS

The invention will be illustrated in further detail in the following detailed description, given purely by way of non-limiting example, with reference to the attached drawings, in which.

Figure 1:
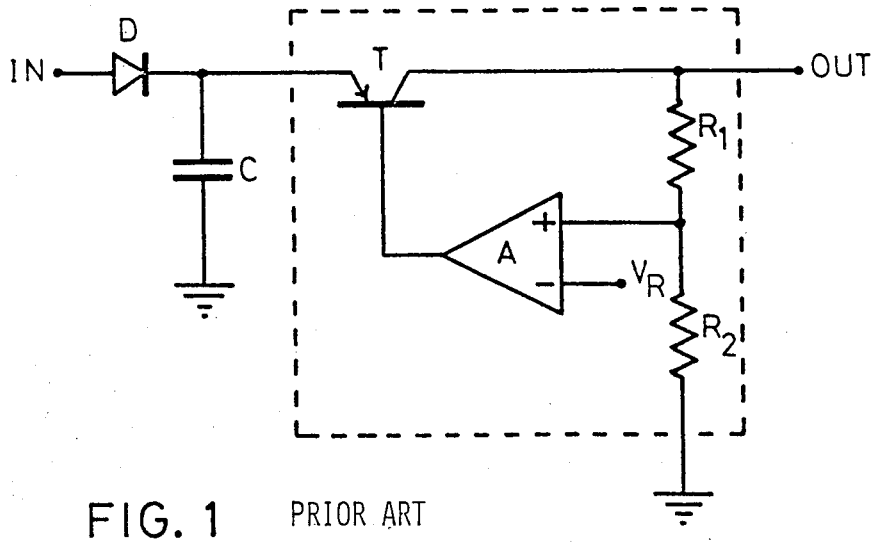
FIG. 1 PRIOR ART
FIG. 1 is a diagram, described above, of a known voltage stabilizer circuit with a "series" type regulation circuit comprising a PNP power transistor.
Figure 2:
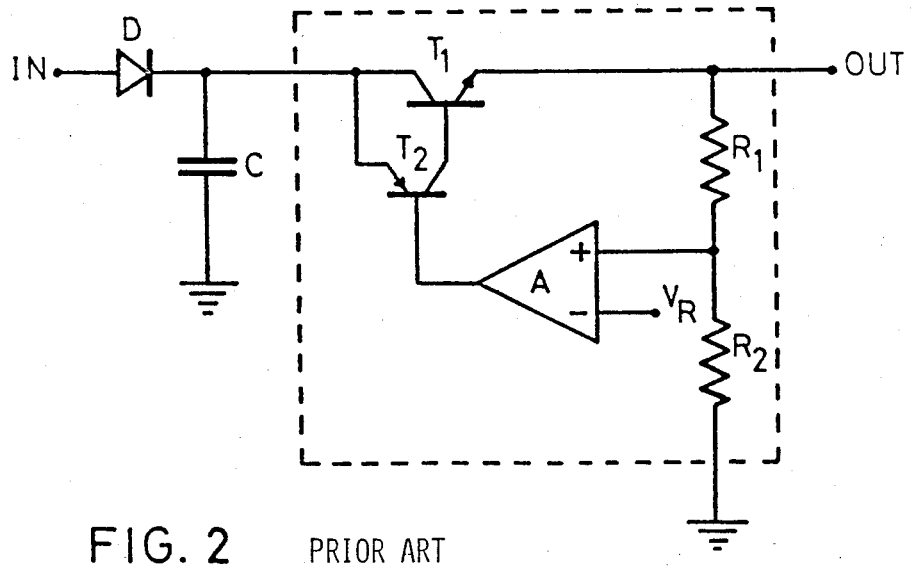
FIG. 2 PRIOR ART
FIG. 2 is a diagram, described above, of a known voltage stabilizer circuit with a "series" type regulation circuit comprising an NPN power transistor.

The same reference letters and numerals are used in the drawing figures for the same components.

DESCRIPTION OF THE PREFERRED EMBODIMENT

Figure 3:
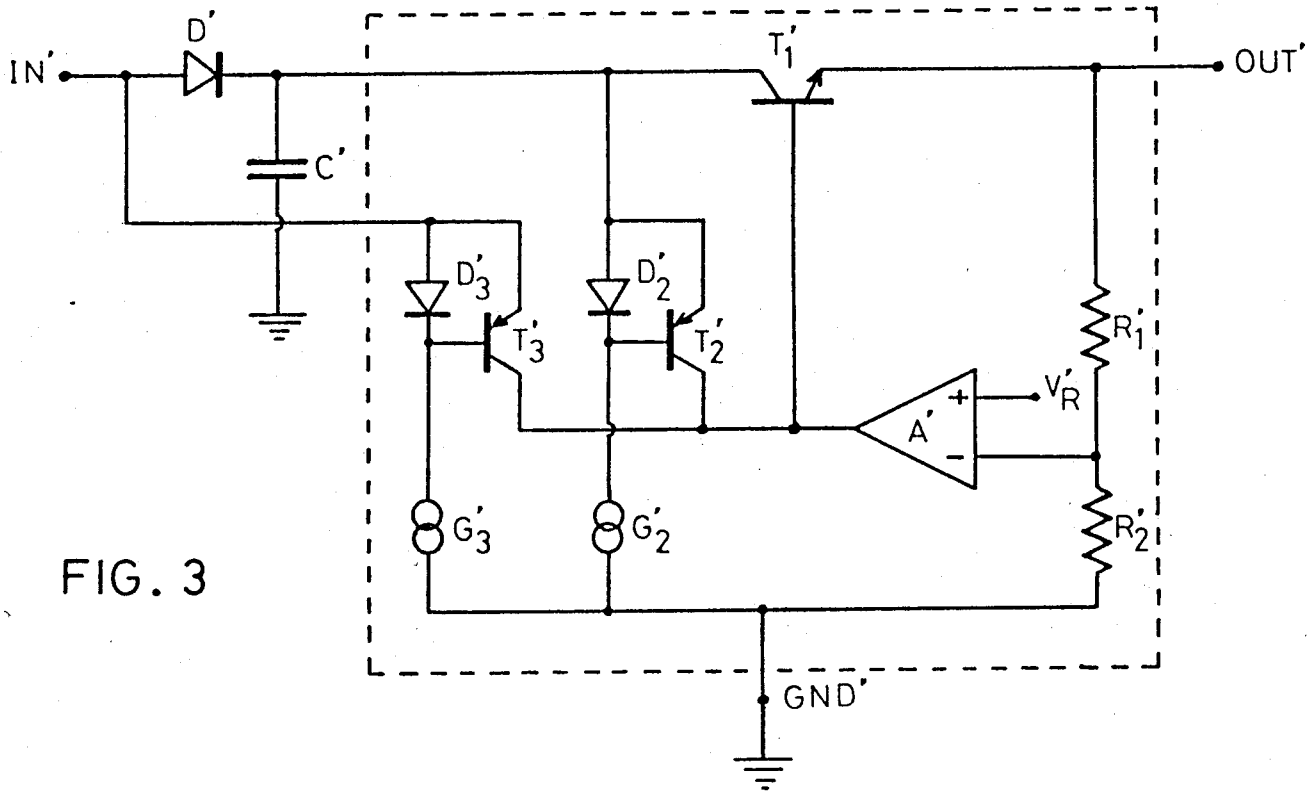
FIG. 3 is a circuit diagram showing a preferred embodiment of a voltage stabilizer in accordance with the present invention.

The circuit diagram of a voltage stabilizer in accordance with the present invention, shown in FIG. 3, comprises a bipolar NPN transistor $T_1'$ whose collector terminal is connected to the cathode of a diode D' and to a first terminal of a capacitor C' whose second terminal is connected to ground.

The circuit diagram also comprises first and second PNP bipolar transistors $T_2'$ and $T_3'$, both having their collector terminals connected to the base terminal of the transistor $T_1'$. The emitter terminal of the transistor $T_2'$ is connected to the cathode of the diode D' and the emitter terminal of the transistor $T_3'$ is connected to the anode of the diode D' in a circuit node which forms an input terminal IN' of the stabilizer.

The emitter terminal of the transistor $T_1'$ output terminal OUT'.

The transistor $T_1'$ is a power transistor; the diode and the capacitor are discrete components.

The base terminal of the transistor $T_1'$ is connected to the output terminal of a differential amplifier A' whose inverting input is connected to the output terminal OUT' via a first resistor $R_1'$ and is connected to a common terminal GND' via a second resistor $R_2'$. This common terminal GND' is connected to ground.

The non-inverting input of the differential amplifier is connected to a voltage reference $V'_R$.

The base terminal of the transistor $T_2'$ is connected to the common terminal GND' via a first constant current generator $G_2'$ and is connected to the cathode of a diode $D_2'$ whose anode is connected to the emitter terminal of the transistor $T_2'$.

The base terminal of the transistor $T_3'$ is connected to the common terminal GND' via a second constant current generator $G_3'$ and is connected to the cathode of a diode $D_3'$ whose anode is connected to the emitter terminal of the transistor $T_3'$.

As in the other drawing figures, the regulation circuit which can be monolithically integrated has been enclosed in a rectangular block shown by dashed lines in FIG. 3; it can in fact be constructed and marketed as a monolithically integrated voltage regulator device.

The transistors $T_2'$ and $T_3'$ may be electrically and physically identical.

In normal operating conditions, when the voltage supplied to the input terminal is sufficiently high, both transistors $T_2'$ and $T_3'$ can conduct.

The drop-out of a voltage stabilizer of the invention therefore has the value:

$$V_{DROP}=V_{BE}+V_{CEsat}$$

tor $T_1$ in conduction, with a value approximately equal to the voltage drop $V_D$ across a diode and $V_{CEsat}$ is the collector-emitter voltage of the transistor $T_3'$ when it is saturated and is thus equal to the minimum voltage which can be obtained with a stabilizer having the diagram of FIG. 1.

At the time, however, of an input negative voltage peak, the transistor $T_3'$ is automatically cut off as a result of the biasing conditions at its terminals and the supply of the transistor $T_1'$ comes exclusively from the transistor $T_2'$ which continues to conduct as a result of the presence of the capacitor C' and the diode D' which prevents its discharge at the input.

Since it remains cut off during the voltage transient, the PNP transistor $T_3'$ can withstand the inverse overvoltage at its terminals without the need for any form of protection, particularly if it is constructed as a "lateral" PNP transistor.

Only the transistors $T_2'$ and $T_3'$ have to supply the base current of the power transistor $T_1'$ so that the overall occupation of integration area for the voltage regulator circuit of a voltage stabilizer of the invention is undoubtedly less than that of the regulation circuit of the known stabilizer with minimal drop-out shown in FIG. 1.

A voltage stabilizer of the invention is thus economically advantageous, since it also makes it possible to use a smaller and less costly output stabilizing capacitor as the power transistor of the regulation loop is of an NPN type.

Although a single embodiment of the invention has been described and illustrated it is obvious that many variants are possible without departing from the scope of the invention.

For example, the circuit biasing means formed by the diodes $D_2'$ and $D_3'$ and by the current generators $G_2'$ and $G_3'$ could be replaced by more complex circuit biasing means designed to keep the transistor $T_2'$ in conduction exclusively during the negative transients of the input voltage so as to prevent useless current absorption.

These circuit means can be constructed in a manner known to persons skilled in the art.

We claim:

1. A voltage regulator circuit comprising:

a first bipolar transistor of a first type of conductivity having a collector terminal and an emitter terminal and a base terminal;

second and third bipolar transistors of a second type of conductivity which is opposite to said first type of conductivity, each of said transistors having a collector terminal and an emitter terminal and a base terminal;

a differential amplifier having first and second input terminals and an output terminal;

said voltage regulator circuit having first and second input terminals and an output terminal and a common terminal;

a circuit biasing means connected between said first and second input terminals and said common terminal and having outputs connected to said base terminals of said second and third transistors;

a voltage divider means connected between said output terminal and said common terminal and having an output connected to said first input terminal of said differential amplifier;

wherein a reference voltage is connected to said second input terminal of said differential amplifier;

and wherein said collector terminal and emitter terminal of said first transistor are respectively connected to said first input terminal and output terminal and said base terminal of said first transistor is connected to said output of said differential amplifier and said collector terminal and emitter terminal of said second transistor are respectively connected to said output of said differential amplifier and said first input terminal; and wherein said collector terminal and said emitter terminal of said third transistor are respectively connected to said output of said differential amplifier and said second input terminal.

2. A voltage regulator circuit as recited in claim 1, when said circuit biasing means comprises a first diode connected between said base and emitter terminals of said second transistor and a second diode connected between said base and emitter terminals of said third transistor and further comprising first and second constant current generators, said first constant current generator being connected between said base terminal of said second transistor and said common terminal and said second current generator being connected between said common terminal and said base terminal of said third transistor.

3. A voltage regulator circuit as recited in claim 2, wherein said third transistor comprises a lateral PNP bipolar transistor.

4. A voltage regulator as recited in claim 2, wherein said first bipolar transistor is an NPN transistor and said second and third transistors are PNP transistors.

5. A voltage regulator circuit as recited in claim 4, wherein said third transistor comprises a lateral PNP bipolar transistor.

6. A voltage regulator circuit as recited in claim 2, further comprising a capacitor element connected between said first input terminal and said common terminal and a diode connected between a power source and said first input terminal, said second input terminal being directly connected to said power source.

7. A voltage regulator circuit as recited in claim 6, wherein said third transistor comprises a lateral PNP bipolar transistor.

8. A voltage regulator as recited in claim 6, wherein said first bipolar transistor is an NPN transistor and said second and third transistors are PNP transistors.

9. A voltage regulator circuit as recited in claim 8, wherein said third transistor comprises a lateral PNP bipolar transistor.

10. A voltage regulator circuit as recited in claim 1, further comprising a capacitor element connected between said first input terminal and said common terminal and a diode connected between a power source and said first input terminal, said second input terminal being directly connected to said power source.

11. A voltage regulator circuit as recited in claim 10, wherein said third transistor-comprises a lateral PNP bipolar transistor.

12. A voltage regulator as recited in claim 10, wherein said first bipolar transistor is an NPN transistor and said second and third transistors are PNP transistors.

13. A voltage regulator circuit as recited in claim 12, wherein said third transistor comprises a lateral PNP bipolar transistor.

14. A voltage regulator as recited in claim 1, wherein said first bipolar transistor is an NPN transistor and said second and third transistors are PNP transistors.

15. A voltage regulator circuit as recited in claim 14, wherein said third transistor comprises a lateral PNP bipolar transistor.

16. A voltage regulator circuit as recited in claim 1, wherein said third transistor comprises a lateral PNP bipolar transistor.

* * * * *